US006365810B1

(12) United States Patent
Enhoffer et al.

(10) Patent No.: US 6,365,810 B1
(45) Date of Patent: Apr. 2, 2002

(54) SHAKER INSTRUMENT

(75) Inventors: Raymond Enhoffer, Clifton; Richard Simons, Garfield, both of NJ (US)

(73) Assignee: Latin Percussion, Inc., Garfield, NJ (US)

( * ) Notice: Subject to any disclaimer, the term of this patent is extended or adjusted under 35 U.S.C. 154(b) by 0 days.

(21) Appl. No.: 09/765,724

(22) Filed: Jan. 17, 2001

(51) Int. Cl.[7] ..... G10D 13/08
(52) U.S. Cl. ..... 84/402; 84/404; 446/421
(58) Field of Search ..... 84/402, 404, 408; 446/418, 419, 421, 397

(56) References Cited

U.S. PATENT DOCUMENTS 4,454,204 A * 6/1984 Posey
5,808,215 A * 9/1998 Kralik et al. ..... 84/402
6,302,813 B1 * 10/2001 Sturgeon et al. ..... 473/564

FOREIGN PATENT DOCUMENTS

FR 2798502 * 3/2001
JP 411305765 * 11/1999

* cited by examiner

*Primary Examiner*—Shih-Yung Hsieh
(74) *Attorney, Agent, or Firm*—Ohlandt, Greeley, Ruggiero & Perle, LLP

(57) ABSTRACT

There is provided a shaker instrument having a single, contiguous body with a sounding chamber that is in communication with an elongated hollow neck or handle. The hollow handle has an opening or aperture through which a fill material may be introduced to, or removed from, the sounding chamber. The fill material is restricted to the sounding chamber by a plug or insert that is placed through the opening and extends into the elongated hollow neck. In addition, there is provided a method of making such a shaker instrument. The method is simplified compared to prior art methods and eliminates any relatively weak and possibly unsafe seams on the instrument.

19 Claims, 2 Drawing Sheets

SHAKER INSTRUMENT

BACKGROUND OF THE INVENTION

1. Field of the Invention

The present invention generally relates to musical instruments and methods of making musical instruments. In particular, the present invention relates to "shaker" instruments, such as maracas, and methods of making such instruments.

2. Description of the Prior Art

Shaker instruments are staples for musicians of Latin music. As used herein, the term "shaker instrument" includes any musical instrument having a hollow sounding chamber filled with a material that strikes the wall or walls of the hollow sounding chamber when the instrument is moved and, thereby, produces sound. Shaker instruments include maracas, tubular shakers, egg-shaped shakers, ganzas, caxixis, and "African" shakers. For example, a traditional maraca may be made from a hollow, dry gourd containing dried seeds that produce a rattle when the gourd is shaken. Shaker instruments may also have a handle.

The sound made by a shaker instrument depends upon several factors including the material used to form the sounding chamber, the fill material placed in the sounding chamber, as well as the shape and size of the sounding chamber. In general, the desired dry and quick sound of shaker instruments is achieved by restricting the fill material to a spherical or semi-spherical sounding chamber.

Shaker instruments made of thermoplastic materials, such as polystyrene, are becoming ever more common. Plastic shaker instruments are easier to produce compared to shaker instruments that are made with other materials, such as wood. In addition, plastic shaker instruments are more durable than their wooden counterparts.

Plastic shaker instruments are typically molded in at least two pieces that are bonded to one another after a fill material is placed in the sounding chamber. However, bonded multiple-piece shaker instruments are more costly to make because the process has additional steps compared to processes for making single-piece instruments. In addition, due to the relatively weak seams inevitably formed at the junction of the pieces, a bonded multiple-piece shaker instrument may separate more easily during use and may not pass child safety testing.

In light of the foregoing there is a need for a plastic shaker instrument that is molded as one piece, yet has a fill material restricted to the sounding chamber.

SUMMARY OF THE INVENTION

It is an object of the present invention to provide a shaker instrument.

It is another object of the present invention to provide a shaker instrument molded from a thermoplastic material.

It is a further object of the present invention to provide such a thermoplastic shaker instrument that is molded as a single piece, yet allows a fill material to be introduced and/or removed from its sounding chamber.

It is yet another object of the present invention to provide a method of making a thermoplastic shaker instrument that is molded as a single piece having an aperture that allows a fill material to be introduced and/or removed from its sounding chamber, and provides a substantial plug to close the aperture.

In light of the foregoing, there is provided a shaker instrument having a single, contiguous body with a sounding chamber that is in communication with an elongated hollow neck or handle. The hollow handle has an opening or aperture through which a fill material may be introduced to, or removed from, the sounding chamber. The fill material is restricted to the sounding chamber by a plug or insert that is placed through the opening and extends into the elongated hollow neck.

In addition, there is provided a method of making such a shaker instrument. The method is simplified compared to prior art methods and eliminates any relatively weak and possibly unsafe seams on the instrument.

Other objects and features of the present invention are described in conjunction with the following detailed description accompanying drawings.

DETAILED DESCRIPTION OF THE INVENTION

Figure 1:
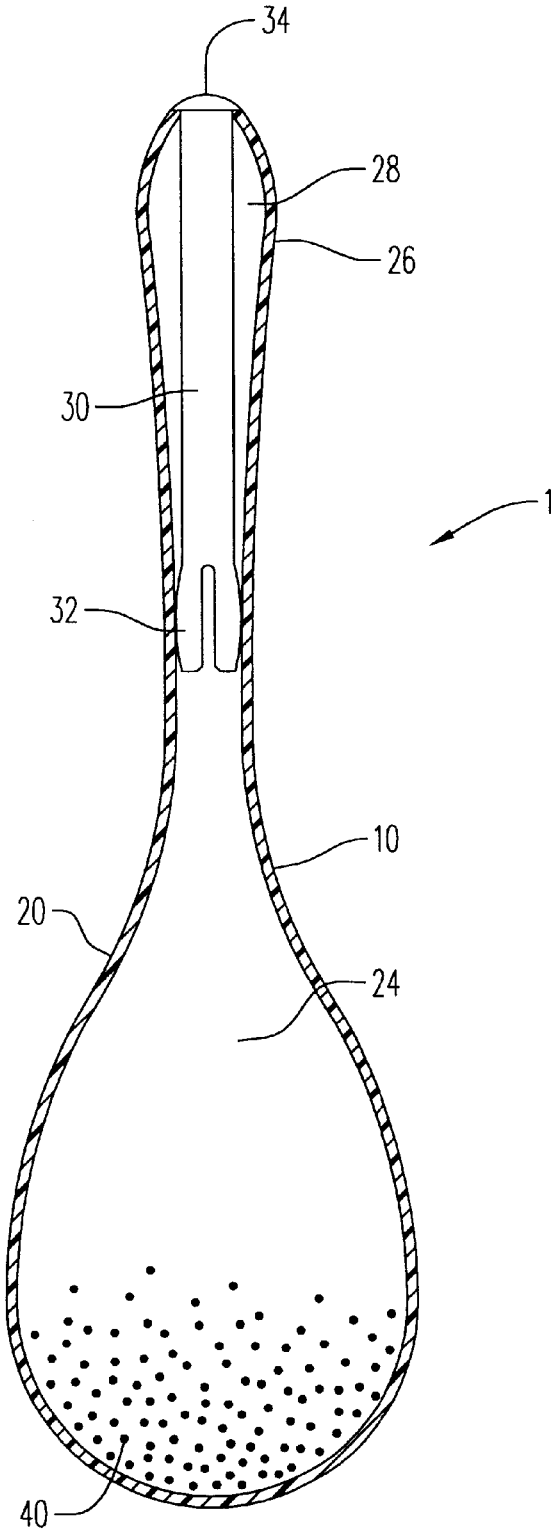
FIG. 1 is a cross sectional view of a shaker instrument according to the present invention.

Referring to the drawings, and in particular, FIG. 1, there is provided a shaker instrument according to the present invention generally represented by reference numeral 1. Shaker instrument 1 has a body 10 and a plug 30.

Body 10 has a body wall 20 and a neck or handle 26 that is continuously connected to the body wall. Body wall 20 and handle 26 define a continuous hollow interior. The body wall 20 defines a hollow interior portion or sounding chamber 24 of the continuous hollow interior. Sounding chamber 24 preferably has a bulbous shape. Handle 26 has a hollow interior portion that defines a neck or handle opening 28. Handle 26 is preferably an elongated section adapted to be gripped by a hand or a mounting device (e.g., a clamp).

Figure 3:
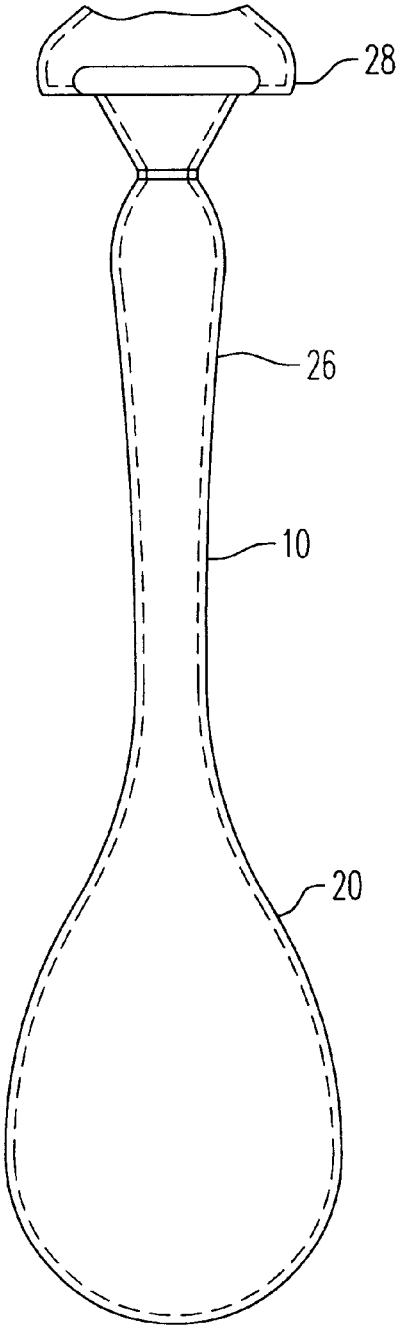
FIG. 3 is an alternative embodiment of the shaker instrument of the present invention.

As shown in FIG. 3, body 10 has a body wall 20 continuously connected to handle 26, which optionally has a funnel surrounding handle opening 28.

Sounding chamber 24 is adapted to hold a fill material 40. Fill material 40 may be any suitable material in any suitable shape. For example, fill material 40 may be steel and/or plastic beads or "shot."

Figure 2:
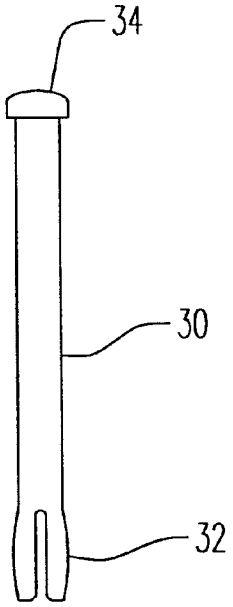
FIG. 2 is a plug for use in the shaker instrument of FIG. 1.

Referring to FIGS. 1 and 2, plug or insert 30 is adapted to seal handle opening 28. Significantly, insert 30 has a shape adapted to occupy a significant portion, if not all, of the interior of handle 26, thereby reducing the hollow space in body 10. In general, since neck 26 preferably has an elongated, tubular shape, insert 30 is also preferably elongated and tubular in shape. In addition, insert 30 is preferably shaped to match the outer contour of handle 26. Thus, insert 30 preferably has a cap portion 34 shaped to match the contour of handle 26.

Insert 30 may be permanently or removably inserted in handle opening. In addition, insert 30 may be held in handle opening 28 by using any suitable means for attaching. For example, insert 30 may be permanently held in handle opening 28 by an adhesive and/or a weld. On the other hand, insert 30 may be removably held in handle opening 28 by a friction fit and/or a threaded connection. As shown more clearly in FIG. 1, insert 30 is permanently held in handle opening 28 by adhesive and, in addition, has a forked end 32 engaged against the interior walls of handle 26. The forked end 32 provides flexibility as the insert 30 is inserted and, preferably, wedged into the hollow portion of handle 26 so that the insert remains rigidly in place.

Body 10, namely sounding chamber wall 20 and handle 26, is preferably made of a thermoplastic material, such as polystyrene. However, any suitable material may be used to form body 10, including other plastics, wood and/or metal including aluminum. In addition, body 10 may be formed with other sections, such as a second handle (not shown). The overall shape and size of body 10 depends only upon the intended function and/or desired aesthetics. As shown in FIG. 1, body 10 is in the shape of a maraca.

Like body 10, insert 30 is preferably made of a thermoplastic material. However, any suitable material may be used to form insert 30, including any other plastic, wood and/or metal including aluminum. Preferably, insert 30 is made of the same material as body 10 to create an overall seamless and aesthetic appearance.

The following is a preferred process for making shaker 1. Body 20 and insert 30 are separately molded using any appropriate molding process and/or apparatus. Body 10 is preferably molded as a substantially single or contiguous piece that eliminates any weak and possibly unsafe seams on the body. Most preferably, body 10 is injection or blow molded. Optionally, body 10 is molded with an integral funnel surrounding handle opening 28. This integral funnel may be removed from body 10 once fill material 40 has been deposited in sounding chamber 24. After body 10 is molded, it is positioned in a fixture below a fill tube or similar device that is preferably sized to matingly fit with handle opening 28. Fill material 40 is passed from the fill tube into sounding chamber 24 through handle opening 26. A small auger may be used to measure the amount of fill material 40 that is deposited in body 10. Once fill material 40 has been deposited in sounding chamber 24, plug 30 is inserted into handle opening 28. Plug 30 occupies a significant portion of handle opening 26, thereby reducing the amount of hollow space within body 20. In effect, once plug 30 is fitted in handle opening 26, fill material 40 is restricted to sounding chamber 24 and cannot pass into handle opening 26. This feature is important in that it effects the sound of the instrument, and at the same time provides strength to the handle of the shaker instrument 1.

The present invention having been thus described with particular reference to a preferred form thereof, it will be obvious that various changes and modifications may be made therein without departing from the spirit and scope of the present invention as defined in the appended claims.

It is claimed:

1. A musical instrument comprising:

a sounding chamber in communication with a hollow neck portion, said hollow neck portion having an opening therein; and an elongated plug insertable in said opening and extending into said hollow neck portion;

whereby a fill material placed in said sounding chamber cannot not pass into said hollow neck portion when said plug is inserted in said hollow neck portion.

2. The musical instrument of claim 1, wherein said sounding chamber and said hollow neck are portions of a contiguous, seamless body.

3. The musical instrument of claim 2, wherein said body and said plug are made from thermoplastic materials.

4. The musical instrument of claim 2, wherein said body and said plug are made from plastic, wood, metal, or any combinations thereof.

5. The musical instrument of claim 2, wherein said body and said plug are made from a same thermoplastic material.

6. The musical instrument of claim 2, wherein said hollow neck portion is elongated.

7. The musical instrument of claim 2, wherein said plug is elongated such as to mate in said elongated hollow neck portion.

8. The musical instrument of claim 1, wherein said elongated plug is permanently held in said hollow neck portion.

9. The musical instrument of claim 1, wherein said elongated neck portion further comprises a funnel surrounding said opening.

10. A method of making a musical instrument comprising the steps of:

forming a single contiguous body having a sounding chamber and an neck portion, said sounding chamber being in communication with said hollow neck portion, said elongated hollow neck portion having an opening therein;

forming an elongated plug in a shape that is insertable in said opening and extendable into said hollow neck portion;

depositing a fill material through said opening and said hollow neck portion into said sounding chamber; and inserting said elongated plug into said body, whereby said fill material cannot pass into said hollow neck portion.

11. The method of claim 10, wherein said body and said plug are made from thermoplastic material.

12. The method of claim 10, wherein said body and said plug are made from a same thermoplastic material.

13. The method of claim 10, wherein said body and said plug are made from plastic, wood, metal, or any combinations thereof.

14. The method of claim 10, wherein a funnel surrounding said opening is formed with said body.

15. The method of claim 10, further comprising means for securing said plug in said hollow neck portion.

16. The method of claim 15, wherein said means for securing said plug in said hollow neck portion is selected from a group consisting of adhesive, weld, friction fit and threaded connection.

17. The method of claim 10, wherein said hollow neck portion is elongated.

18. The method of claim 17, wherein said plug is elongated such as to mate in said elongated hollow neck portion.

19. The method of claim 17, wherein said elongated plug is permanently held in said hollow neck portion.

* * * * *